US006374719B1

(12) United States Patent
Phillips

(10) Patent No.: US 6,374,719 B1
(45) Date of Patent: Apr. 23, 2002

(54) AMMUNITION HOLDER

(76) Inventor: David Anthony Phillips, 453 Hidden Valley, Coppell, TX (US) 75019

( * ) Notice: Subject to any disclaimer, the term of this patent is extended or adjusted under 35 U.S.C. 154(b) by 0 days.

(21) Appl. No.: 09/580,836

(22) Filed: May 30, 2000

(51) Int. Cl.[7] ..... F41A 9/69
(52) U.S. Cl. ..... 89/34; 42/50; 42/90; 206/3
(58) Field of Search ..... 89/34; 206/3; 42/87, 42/90, 49.01, 50

(56) References Cited

U.S. PATENT DOCUMENTS

| | | | | | |
|---|---|---|---|---|---|
| 164,890 | A | | 6/1875 | White | |
| 169,636 | A | | 11/1875 | Hare | |
| 368,579 | A | * | 8/1887 | Frazier | |
| 394,376 | A | | 12/1888 | Kelton | |
| 2,366,886 | A | * | 1/1945 | Van Tuyl | 206/3 |
| 3,473,991 | A | | 10/1969 | Ludwig | |
| 4,199,057 | A | * | 4/1980 | Gruaz | 206/3 |
| 4,830,246 | A | | 5/1989 | Ryan | 224/221 |
| 4,869,009 | A | * | 9/1989 | Bennett | 42/87 |
| 5,056,661 | A | | 10/1991 | Balzano | 206/372 |
| 5,121,564 | A | * | 6/1992 | Story | 42/90 |
| 5,152,442 | A | * | 10/1992 | Gallagher | 224/245 |
| 5,265,365 | A | * | 11/1993 | Finn | 42/74 |
| 5,271,176 | A | | 12/1993 | Anderson et al. | 42/106 |
| 5,289,961 | A | | 3/1994 | Levitt et al. | 224/219 |
| 5,996,865 | A | * | 12/1999 | Bissey | 224/275 |

FOREIGN PATENT DOCUMENTS

| | | | | |
|---|---|---|---|---|
| FR | 1375876 | * | 9/1964 | 42/87 |
| GB | 22583 | * | 7/1913 | 42/87 |

* cited by examiner

*Primary Examiner*—Stephen M. Johnson
(74) *Attorney, Agent, or Firm*—Stephen R. Greiner

(57) ABSTRACT

A holder for lead pellets of the type shot from an air rifle and similar types of ammunition. The ammunition holder includes a base plate and at least one strap extending from the top and bottom of the base plate for attachment to a support such as the butt portion of an air rifle stock. A resilient block is affixed to the base plate. The block has a number of transverse apertures each being sized to snugly receive a pellet or other piece of ammunition.

7 Claims, 1 Drawing Sheet

AMMUNITION HOLDER

FIELD OF THE INVENTION

The present invention relates generally to package and article carriers and, in particular, to carriers for ammunition.

BACKGROUND OF THE INVENTION

Users of air rifles have always had a difficult time transporting ammunition in a manner where it can be quickly and easily be loaded for firing. Such ammunition often takes the form of small pellets that are difficult to grasp and manipulate. Furthermore, the pellets are usually housed in small boxes that must be opened and closed each time a pellet is loaded into an air rifle—a time-consuming and noisy step that does, to its credit, prevent loss of, and damage to, pellets. For a hunter, however, a fraction of a second can often make the difference between taking an effective shot at a game animal or foregoing the shot altogether.

SUMMARY OF THE INVENTION

In light of the problems associated with the known products for carrying air rifle pellets, it is a principal object of the invention to provide an ammunition holder that secures a plurality of pellets to an air rifle in a manner where they can be readily grasped by a user and quietly loaded into an air rifle with the minimum of game-istracting motion. Use of the holder makes loading an air rifle a fast, quiet and motion-conserving operation. Fewer shots at game animals will, thus, be lost during use of the holder than had been the case in the past.

It is another object of the invention to provide an ammunition holder of the type described that can be secured to unmodified, air rifles of a variety of brands and styles. If desired, the ammunition holder may be carried upon the forearm or wrist of a user. Neither special tools nor training are required to secure and use the ammunition holder.

It is a further object of the invention to provide an ammunition holder that will retain pellets in a spaced-apart, easy-to-grasp relationship where they cannot scratch or otherwise cause damage to one another and an air rifle. While retained, pellets are isolated from dust and dirt.

It is an object of the invention to provide improved elements and arrangements thereof in an ammunition holder for the purposes described which is lightweight in construction, inexpensive to manufacture, and dependable in use.

Briefly, the ammunition holder in accordance with this invention achieves the intended objects by featuring a base plate having a convex front surface and a concave rear surface and pair of slots at its top and its bottom. A strap extends through the slots and outwardly from the base plate. The strap has hook-and-loop fasteners attached to its opposed ends so that it can be selectively formed into a band. A resilient block is affixed to the front surface of the base plate. The block has a plurality of apertures that are sized to snugly receive a piece of ammunition and that terminate at the front surface of the base plate. The block, being of constant thickness, has a convex front surface that is parallel to the front surface of the base plate.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
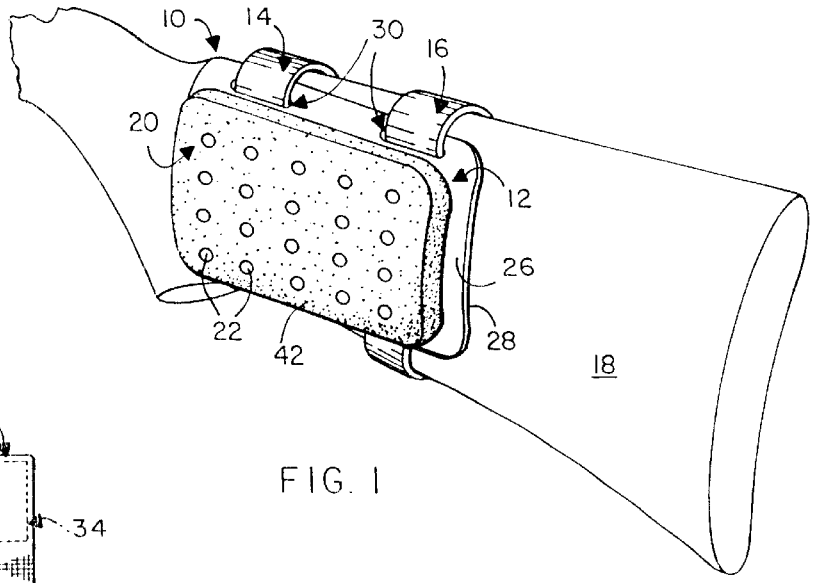
FIG. 1 is a perspective view of an ammunition holder in accordance with the invention mounted upon the butt portion of a stock of a firearm.
Figure 2:
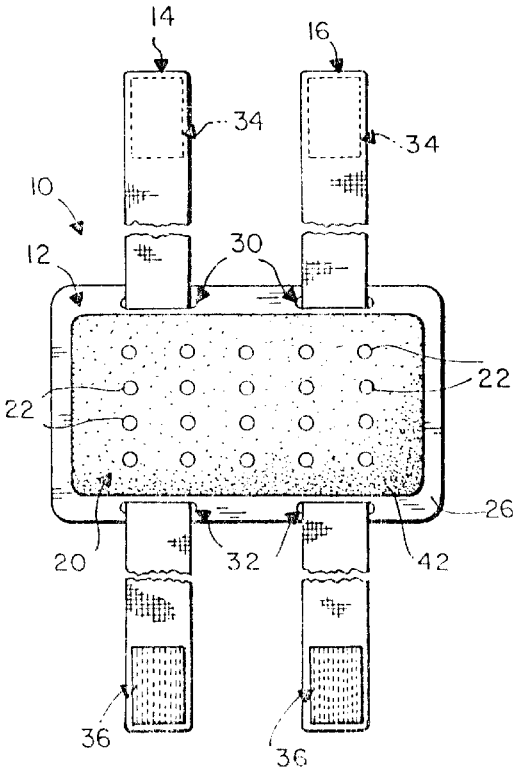
FIG. 2 is a front view of the ammunition holder with portions of its retaining straps broken away.

Referring now to the FIGS., an ammunition holder in accordance with the present invention is shown at 10. Holder 10 includes a base plate 12 having a pair of straps 14 and 16 extending from its top and bottom for attachment to the butt portion 18 of a firearm stock. A resilient block 20 is affixed to base plate 12. Block 20 is provided with a plurality of transverse apertures 22 each being sized to snugly receive a lead pellet 24 of the type shot from an air rifle.

Base plate 12 is formed from a rigid, plastic material so as to have a convex front surface 26 and concave rear surface 28 contoured to fit closely against a side of butt portion 18. A pair of transverse slots 30 at the top of base plate 12 connects surfaces 26 and 28 together. A similar pair of transverse slots 32 adjacent the bottom of base plate 12 also joins surfaces 26 and 28 together. As shown, slots 30 and 32 are vertically aligned.

Straps 14 and 16 are formed of woven, nylon webbing and are extended vertically through slots 30 and 32 in a side-by-side relationship. Hook and loop fasteners 34 and 36 are attached to opposite ends of straps 30 and 32 to permit them to be formed into separate bands of adjustable size. Each fastener 34 comprises a strip of "Velcro" pile material including a dense mat of small, uncut loops 38 formed of thread. Each fastener 36, however, comprises a strip of "Velcro" hook material having a plurality of transverse lines of hooks 40 spaced along its length. The ends of hooks 40 are turned inwardly so as to catch in loops 38 when fasteners 34 and 36 are pressed together.

Block 20 is a piece of neoprene or other closed-cell, foam rubber material about 0.25 inches (0.64 cm) thick, i.e., a dimension slightly greater than the length of pellets 24, that is adhesively attached to convex front surface 26 of base plate 12. Since block 20 is flexible, relatively thin and of constant thickness, it acquires a convex front surface 42 parallel to surface 26 when attached to base plate 12. Apertures 22 connect surfaces 42 and 26 together and are spaced from one another at a distance between which the fingers 44 and 46 of a user's hand can be positioned.

Ammunition holder 10 is easily mounted. First, concave surface 28 of base plate 12 is positioned adjacent a side of butt portion 18. Next, straps 14 and 16 are extended tightly around butt portion 18; and, then, they are formed into releasable bands by firmly pressing fasteners 34 and 36 together. With ammunition holder 10 now mounted on butt portion 18, it can be charged with pellets 24.

Charging ammunition holder 10 with pellets 24 is straightforward. A pellet 24 is, first, grasped between the index finger 44 and thumb 46 of a user. Then, the grasped pellet 24 is inserted into an aperture 22 in block 20 so that its tapered nose 48 abuts surface 26 of base plate 12 and its skirt 50 is closely adjacent surface 42 of block 20, the curvature of surface 42 facilitating positioning of pellets 24 into apertures 22. (Note: plate 12 protects butt portion 18 by isolating it from pellets 24 while block 20 retains pellets 24, now fully imbedded therein, in a safe and handy manner.) These steps are repeated until each aperture 22 in block 20 contains a pellet 24.

Figure 3:
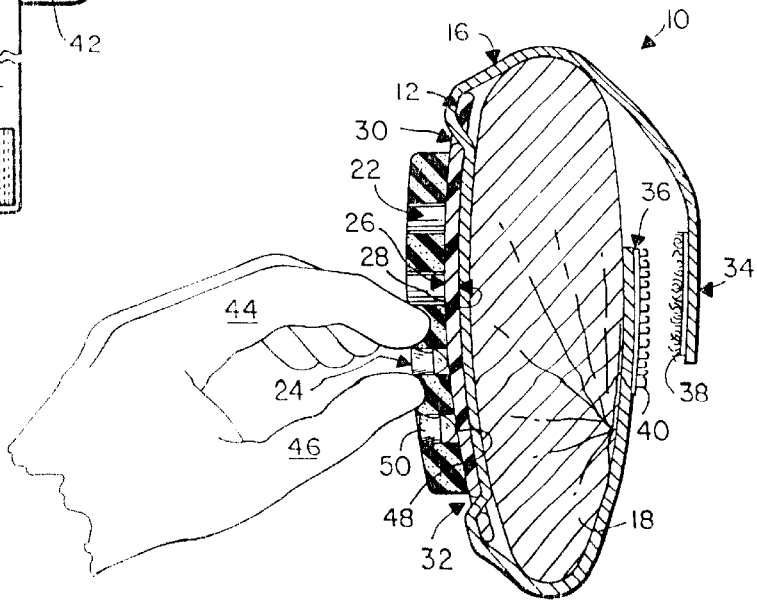
FIG. 3 is a lateral cross-sectional view of the ammunition holder of FIG. 1.

Removing pellets 24 from block 20 to load an air rifle is equally simple. The user need only press surface 42 toward surface 26 with his index finger 44 spaced from thumb 46 and on. opposite sides of an aperture 22 containing a pellet 24—the curvature of surface 42 facilitating the positioning of finger 44 and thumb 46 astride a pellet 24. A slight pressure compresses block 20 leaving a pellet 24 exposed and ready to be grasped as shown in FIG. 3. The grasped pellet 24 may now be loaded into the firing chamber (not shown) of a firearm in a conventional manner. Since holder 10 is mounted upon the butt portion 18 of a firearm stock, a pellet 24 need not be moved a great distance for loading into the firing chamber. When the pressure applied by finger 44 and thumb 46 is released, block 20 springs back to its original, uncompressed shape.

After use, ammunition holder 10 may be removed from butt portion by grasping the opposite ends of straps 14 and 16 and pulling outwardly. This will cause hooks 40 and loops 38 to disengage. The transverse line of disengagement will progress lengthwise of the interlocked fasteners 34 and 36 so that they will separate smoothly. Ammunition holder 10 may be cleaned, if necessary, by rinsing with water and, then, stored or transported in a flat, relatively compact condition away from butt portion 18 or on butt portion 18 for ready reuse. For many hunters, difficulties in transporting and loading ammunition will be a thing of the past.

While the invention has been described with a high degree of particularity, it will be appreciated by those skilled in the art that modifications may be made thereto. For example, the number, location and diameter of apertures 22 as well as the length, width and thickness of block 20 could be varied to accommodate virtually any number and type ammunition like: BBs, bullet cartridges and round shot utilized by black powder enthusiasts. Therefore, it is to be understood that the present invention is not limited to the sole embodiment described above, but encompasses any and all embodiments within the scope of the following claims.

I claim:

1. An ammunition holder, comprising:

a substantially rigid base plate;

a flexible strap having opposed ends extending from the top and bottom of said base plate;

a pair of releasable fasteners each being respectively attached to one of said opposed ends of said strap so that said strap can be selectively formed into a closed band; and, a resilient foam block affixed to said base plate, said block having a plurality of transverse apertures each being sized to snugly receive a piece of ammunition, said apertures fully penetrating said block and opening to said base plate.

2. The ammunition holder according to claim 1 wherein said base plate has a convex front surface and concave rear surface.

3. The ammunition holder according to claim 2 wherein said block is attached to said convex front surface of said base plate.

4. The ammunition holder according to claim 1 wherein said releasable fasteners include:

a first fastener having a dense mat of small, uncut loops;

a second fastener being adapted to mate with, and releasably adhere to, said first fastener, said second fastener having a plurality of hooks releasably fastenable with said loops of said first fastener.

5. An ammunition holder, comprising:

a base plate having a front surface and a rear surface and a pair of slots at its top and its bottom connecting said front surface and said rear surface;

a strap extending through said slots and outwardly from the top and bottom of said base plate, said strap having opposed ends and releasable fasteners attached to each of said opposed ends, said releasable fasteners including:

a first fastener having a dense mat of small, uncut loops;

a second fastener being adapted to mate with, and releasably adhere to, said first fastener, said second fastener having a plurality of hook releasably fastenable with said loops of said first fastener; and, a resilient block formed of foam rubber and being affixed to said front surface of said base plate, said block having a plurality of transverse apertures each being sized to snugly receive a piece of ammunition and terminating at said front surface of said base plate.

6. The ammunition holder according to claim 5 wherein said base plate and said resilient block include convex front surfaces that are parallel to one another.

7. An ammunition holder, comprising:

a base plate having a convex front surface and a concave rear surface and pair of slots at its top and its bottom connecting said convex front surface with said concave rear surface;

a strap extending through said slots and outwardly from the top and bottom of said base plate, said strap having opposed ends and releasable fasteners attached to each of said opposed ends, said releasable fasteners including:

a first fastener attached to one of said opposed ends and having a dense mat of small, uncut loops;

a second fastener attached to the other of said opposed ends and being adapted to mate with, and releasably adhere to, said first fastener, said second fastener having a plurality of hooks releasably fastenable with said loops of said first fastener; and, a resilient block formed of foam rubber and being affixed to said front surface of said base plate, said block having a plurality of transverse apertures each being sized to snugly receive a piece of ammunition and terminating at said front surface of said base plate, and said resilient block having a convex front surface that is parallel to said convex front surface of said base plate.

* * * * *